US006236377B1

(12) United States Patent
Hussaini et al.

(10) Patent No.: US 6,236,377 B1
(45) Date of Patent: May 22, 2001

(54) ANTENNA WITH UNIVERSAL MOUNTING ASSEMBLY

(75) Inventors: Saied Hussaini; Marc Iacovelli, both of Miami, FL (US)

(73) Assignee: Rally Manufacturing, Inc., Miami, FL (US)

( * ) Notice: Subject to any disclaimer, the term of this patent is extended or adjusted under 35 U.S.C. 154(b) by 0 days.

(21) Appl. No.: 09/556,696

(22) Filed: Apr. 24, 2000

(51) Int. Cl.[7] ..... H01Q 1/32
(52) U.S. Cl. ..... 343/882; 343/715; 343/888
(58) Field of Search ..... 434/711, 713, 434/715, 880, 882, 888, 900, 901

(56) References Cited

U.S. PATENT DOCUMENTS

| | | | | |
|---|---|---|---|---|
| 4,103,305 | * | 7/1978 | Gualano | 343/715 |
| 4,431,332 | * | 2/1984 | Dieges | 343/715 |
| 5,233,363 | * | 8/1993 | Yarsunas et al. | 343/715 |
| 5,583,522 | * | 12/1996 | Radomski et al. | 343/715 |
| 6,157,345 | * | 12/2000 | Hockett et al. | 343/715 |

* cited by examiner

*Primary Examiner*—Hoanganh Le
*Assistant Examiner*—Hoang Nguyen

(74) *Attorney, Agent, or Firm*—Liniak, Berenato, Longacre & White

(57) ABSTRACT

The invention is a universal replacement antenna assembly for replacing an automobile radio antenna. The antenna assembly includes a universal mounting assembly that fits all cars and trucks and facilitates easy antenna installation. An antenna mast connected to a mounting member having a lower body portion and an upper connecting portion. Pivoting rocker arms pivot from a lower end of the mounting member within a range from an upright, closed position to an open position not exceeding ninety degrees from said closed position. A connecting member is mounted on the antenna mast and is movable with respect to the mast and the mounting member and is connectable with the connecting portion of the mounting member. During installation of the antenna assembly the mounting member and the rocker arms are inserted through a hole in the mounting surface with the rocker arms in the closed position and the connecting member is moved downward and connected to the connecting portion of the mounting member. The rocker arms are pivoted to the open position, and the upper end of the rocker arms are abutted against an inner surface of the mounting surface, thereby securing the antenna assembly to the mounting surface with the antenna mast and the connecting means positioned above the mounting hole.

10 Claims, 2 Drawing Sheets

ANTENNA WITH UNIVERSAL MOUNTING ASSEMBLY

BACKGROUND OF THE INVENTION

1. Field of the Invention

This invention relates to a replaceable, collapsible antenna, especially for automotive use. More particularly the invention concerns a universal mounting assembly which facilitates easy replacement and mounting of the antenna.

2. Description of Related Art

Collapsible antennas are commonly used on automobiles. Such antennas are typically mounted in a fender. The collapsible antenna can be original equipment or can be an after market automobile accessory installed by the automobile owner. Such antennae are susceptible to bending or crimping since the telescoping sections are hollow. This may impede the lowering and raising of the antenna, and replacement of the antenna may be necessary. Existing replacement antennae may be cumbersome to install or may not fit all types of cars and trucks.

It is therefore an object of the invention to provide a means for easy installation of a replacement antenna that requires minimum effort to install.

It is a further object of the invention to provide a universal replacement antenna assembly that fits all cars and trucks.

It is another object of the invention to provide a novel means for securing a replacement antenna, regardless of the whether the antenna is a collapsible or standard antenna.

SUMMARY OF THE INVENTION

The invention is an antenna assembly for installing onto a mounting surface, including an antenna mast connected to a mounting member at a base of the antenna mast. The mounting member has a lower body portion and an upper connecting portion. At least two pivoting rocker arms are pivotable from a lower end of the lower body portion. The rocker arms each have a first lower end pivotably attached to the mounting member and a second upper end. The rocker arms are restricted to be pivotable within a range from an upright, closed position wherein the upper end is positioned above the lower, and an open position not exceeding ninety degrees from the closed position. A connecting member is mounted on the antenna mast so as to be movable with respect to the mast and the mounting member. The connecting member is connectable with the connecting portion of the mounting member.

During installation of the antenna assembly the mounting member and the rocker arms are inserted through and below a hole in the mounting surface with the rocker arms in the closed position, and the connecting member is moved downward and connected to the connecting portion of the mounting member. The rocker arms are pivoted to the open position, and the upper end of the rocker arms are abutted against an inner surface of the mounting surface, thereby securing the antenna assembly to the mounting surface with the antenna mast and the connecting means positioned above the mounting hole.

The invention further includes a spring for biasing the rocker arms to be in the open position. An angle base is provided for angling the antenna mast relative to the mounting surface. A connecting cable attached to the mounting member is connectable to a radio cable.

The connecting portion of the mounting member may be threaded and the connecting member may be a mounting nut, which threadingly engages with the connecting portion.

A gasket mounted between an upper surface of the mounting surface and the connecting member. The antenna assembly further includes a mounting bracket attached to a lower end of the body portion of the mounting member, the bracket having bracket legs to which the rocker arms are pivotably attached. The spring for biasing the rocker arms to be in the open position is in contact with the body portion of the mounting member and the rocker arms.

BRIEF DESCRIPTION OF THE DRAWINGS

The above mentioned advantages and objects of the present invention will further become apparent when taken with the detailed description of the invention and with the drawings in which.

DETAILED DESCRIPTION OF THE INVENTION

Figure 1:
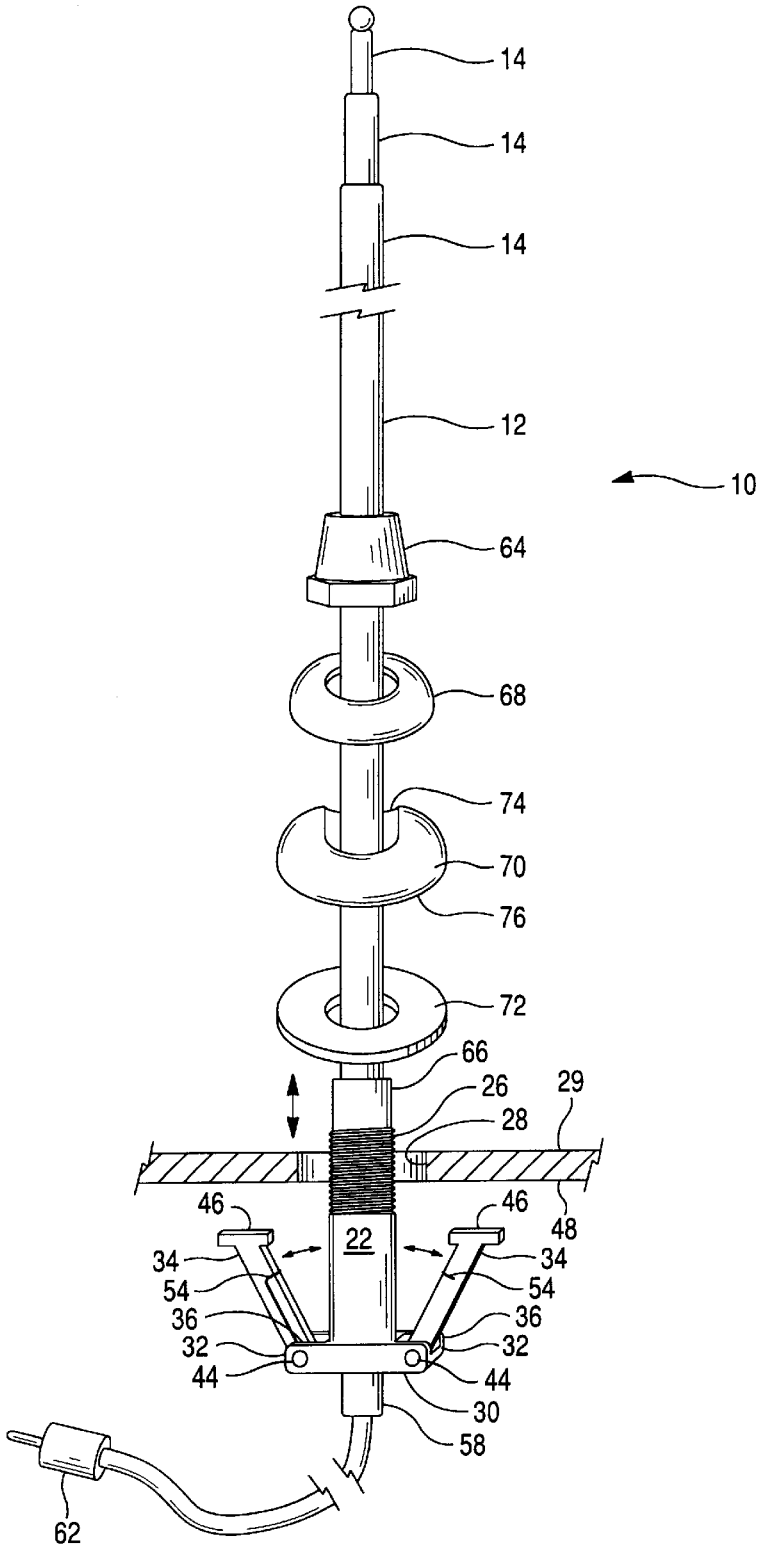
FIG. 1 is a side elevational view of an antenna assembly embodying the present invention.
Figure 2:
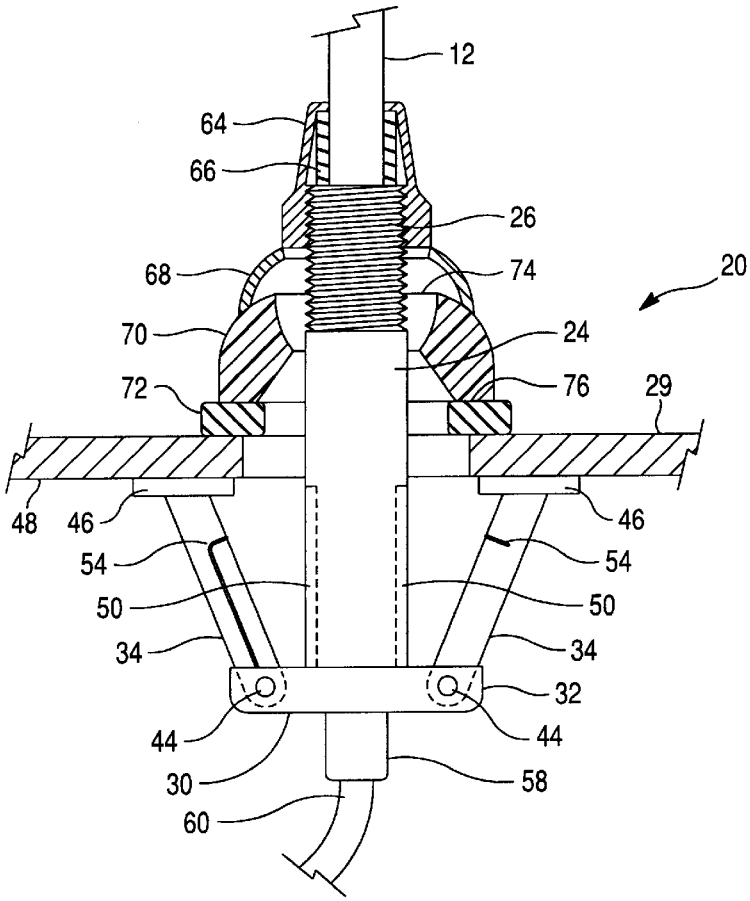
FIG. 2 is a partial sectional view of the antenna of FIG. 1 in an installed position.
Figure 3:
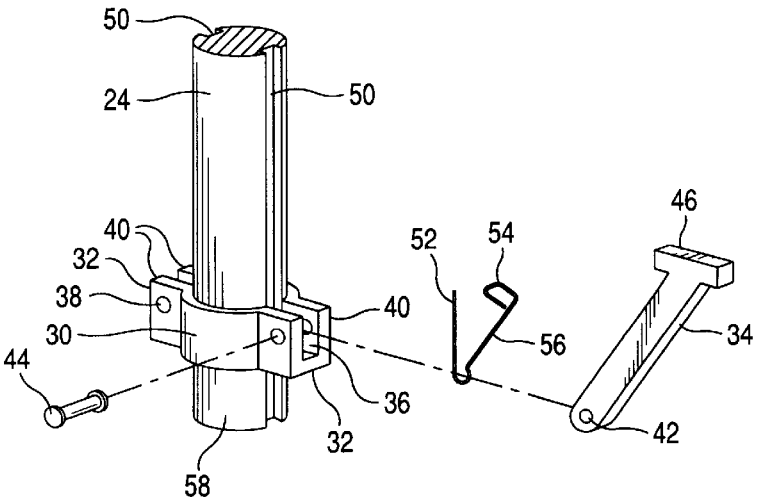
FIG. 3 is a side elevational view of components of the universal mounting assembly according to the invention.

Referring now to FIGS. 1–3, the present invention an antenna assembly 10 embodying the invention is shown. The antenna assembly 10 comprises a collapsible antenna mast 12 comprised of telescoping sections 14. The antenna assembly 10 includes a universal mounting assembly 20, which is the novel aspect of the present invention. The mounting assembly 20 includes a metal mounting member 22, which is attached to the base of the antenna mast 12. The mounting member 22 has a generally cylindrical body 24 with a threaded upper portion 26. The antenna mast 12 is securely fastened by brazing, crimping or threading to the mounting member 22, which extends through an opening 28 in a mounting sheet 29 such as an automobile fender or the like. A support bracket 30 is attached to a lower end of the mounting member 22. The support bracket 30 has opposing horizontally extending legs 32 which support pivoting rocker arms 34.

In a preferred embodiment of the present invention, each bracket leg 32 has a recess 36 in which a lower end of a rocker arm 34 is seated within. A bore 38 extends horizontally through the walls 40 of the bracket leg 32 surrounding the recess 36. Each rocker arm 34 has a pinhole 42 at the lower end thereof so that a pivot shaft 44 extending through the bore 38 and pinhole 42 pivotably attaches the rocker arms 34 to the bracket legs 32. The bracket legs and recesses therein serve to limit the pivotable range of the rocker arms within a range from an upright closed position to a open position as shown in the figures. This ensures that the hands of the rocker arms come into contact with the inner surface of the mounting sheet upon assembly. It will be understood that the manner to connect the pivoting rocker arms to the mounting member and to spring bias the rocker arms may be accomplished by means other than herein described. Support hands 46 are located at the distal end of each rocker arm 34, which abut against an inner surface 48 of the mounting sheet 29, as will be described hereinafter.

Referring now to FIG. 3, the cylindrical body 24 has vertical grooves 50 in the pivoting plane of the rocker arms 34. The grooves 50 receive a leg 52 of a spring 54, which then extends down the groove and winds about the pivot shaft. A second leg 56 of the spring 54 extends up and the rocker arm 34 and hooks about an upper portion of the rocker arm 34 in a manner so as to bias the rocker arms 34 outwardly away from the body 24 of the mounting member 22. A hub 58 portion of the lower end of the bracket 30 receives a flexible connecting cable 60 that connects to the car radio cable (not shown) via an attached radio plug 62 in a manner understood by those skilled in the art.

The universal mounting assembly 20 further comprises a mounting nut 64, a plastic collar 66, a metal base cover 68, a plastic angle base 70, and a rubber gasket 72 which are all mounted concentrically about the mounting member 22. The plastic collar 66 surrounds the base of the antenna mast 12 adjacent to the threaded portion 26 of the mounting member 22 upon which the mounting nut 64 is received when the mounting nut 64 is threadingly engaged with the threaded portion 26. The angle base 70 is generally hemispherical in shape and has a generally conical bore extending therethrough with an oblong oval top opening 74 and a wide circular bottom opening 76. This design allows the antenna assembly 10 to be mounted at a desired angle to orient the antenna mast 12 relative to the mounting surface 29. Angle base 70 and rocker arms 34 orient the antenna mast 12 at a limited desired angle with respect to the sheet 29 so that the antenna rises in the desired direction when it is extended. The base cover 68 serves to cover the oval top opening 74 of the angle base 70 when the mounting nut 64 is tightened. Rubber gasket 72 abuts the mounting surface 29 and protects the surface from contact from the assembly parts mounted above the gasket 72.

The antenna assembly 10 according to the invention may be installed to replace an existing antenna, or may be a new installation. An existing mounting hole 28 may be used or a new hole can be drilled into the mounting surface 29. The hole must be large enough to allow the mounting bracket 30 and rocker arms 34 to pass therethrough when the rocker arms 34 are pivoted towards the cylindrical body 24 of the mounting member 22 against the bias of the springs 54, in a closed or vertical position. After the radio plug 62 is attached to the car radio cable (not shown) in the appropriate manner, the lower end of the antenna assembly 10 including the connecting cable 60, mounting bracket 30 and rocker arms 34, is inserted through the hole 28 in the mounting surface 29. The rocker arms 34 are pivoted into the closed, vertical position while the lower end is inserted through the hole 28.

Once the rocker arms 34 have passed through the hole 28 and released, the rocker arms 34 pivot outward to an extended position as shown in FIGS. 1 and 2. The antenna assembly 10 is secured to the sheet 29 by pulling upward on the antenna mast 12 so that the hands 46 of the rocker arms 34 contact the inner surface 48 of the sheet 29. The mounting nut 64 is then tightened onto the threaded portion 26 of the mounting member 22, thereby assembling the gasket 72, angle base 70 and base cover 68 as shown in FIG. 2. The angle base 70 may be rotated during the assembly to adjust the antenna mast 12 to the desired angle with respect to the sheet 29. It will be understood by those skilled in the art that the metal hands 46 of the rocker arms 34 contacting the inner surface 48 of the metal mounting sheet 29 will properly ground the radio cable to antenna connection.

Having thus described various exemplary embodiments of the invention, it will be understood by those skilled in the art that modifications or changes in details of the invention may be implemented without departing from the spirit and scope of the invention as defined in the following claims.

What is claimed is:

1. An antenna assembly for installing onto a mounting surface, comprising:

an antenna mast connected to a mounting member at a base of said antenna mast, said mounting member comprising a lower body portion and an upper connecting portion; at least two pivoting rocker arms pivotable from a lower end of said lower body portion, said rocker arms each having a first lower end pivotably attached to said mounting member and a second upper end;

restricting means for restricting the rocker arms to be pivotable only within a range from an upright, closed position wherein said upper end is positioned above said lower end such that the rocker arms are adjacent to said mounting member, and an open position not exceeding ninety degrees from said closed position; and a connecting member mounted on said antenna mast which is movable with respect to said mast and said mounting member, said connecting member connectable with said connecting portion of said mounting member, wherein during installation of said antenna assembly said mounting member and said rocker arms are inserted through and below a hole in the mounting surface with said rocker arms in the closed position, said connecting member is moved downward and connected to the connecting portion of the mounting member, said rocker arms are pivoted to the open position, and said upper end of said rocker arms are abutted against an inner surface of the mounting surface, thereby securing said antenna assembly to said mounting surface with said antenna mast and said connecting means positioned above said mounting hole.

2. The antenna assembly according to claim 1, further comprising spring means for biasing said rocker arms to be in the open position.

3. The antenna assembly according to claim 1, further comprising angling means for angling said antenna mast relative to the mounting surface.

4. The antenna assembly according to claim 3, wherein said angling means is mounted on said antenna mast between said connecting member and said rocker arms.

5. The antenna assembly according to claim 1, further comprising a connecting cable attached to said mounting member, said connecting cable being connectable to a radio cable.

6. The antenna assembly according to claim 1, wherein said connecting portion of said mounting member is threaded and said connecting member is a mounting nut which threadingly engages with said connecting portion.

7. The antenna assembly according to claim 1, further comprising a gasket mounted between an upper surface of the mounting surface and the connecting member.

8. The antenna assembly according to claim 1, further comprising telescoping antenna sections mounted within said antenna mast, said telescoping antenna section adapted to be raised and lowered with respect to said antenna mast.

9. The antenna assembly according to claim 1, further comprising a mounting bracket attached to a lower end of said body portion of said mounting member, said bracket having bracket legs to which said rocket arms are pivotably attached.

10. The antenna assembly according to claim 9, further comprising spring means for biasing said rocker arms to be in the open position, wherein said spring means is in contact with said body portion of said mounting member and said rocker arms.

* * * * *